US008770669B2

(12) United States Patent
Wachsmann et al.

(10) Patent No.: US 8,770,669 B2
(45) Date of Patent: Jul. 8, 2014

(54) CUTTING TOOL CONFIGURATION HAVING WEAR DISC

(75) Inventors: Steffen Wachsmann, Koblenz (DE); Peter Erdmann, Emmelshausen (DE)

(73) Assignee: BOMAG GmbH, Boppard (DE)

( * ) Notice: Subject to any disclaimer, the term of this patent is extended or adjusted under 35 U.S.C. 154(b) by 30 days.

(21) Appl. No.: 13/174,426

(22) Filed: Jun. 30, 2011

(65) Prior Publication Data

US 2012/0068526 A1 Mar. 22, 2012

(30) Foreign Application Priority Data

Jul. 5, 2010 (DE) ..... 10 2010 026 106

(51) Int. Cl.
*E21C 35/18* (2006.01)

(52) U.S. Cl.
USPC ..... 299/104

(58) Field of Classification Search
USPC ..... 299/100–111, 112 R, 112 T, 113
See application file for complete search history.

(56) References Cited

U.S. PATENT DOCUMENTS 4,201,421 A 5/1980 Besten et al.
4,632,463 A * 12/1986 Sterwerf, Jr. ..... 299/104
6,644,755 B1 * 11/2003 Kammerer ..... 299/104
2005/0173966 A1 8/2005 Mouthaan
2007/0152495 A1 * 7/2007 Sollami ..... 299/107

FOREIGN PATENT DOCUMENTS

DE 43 06 206 A1 9/1994
DE 198 56 916 C1 8/2000
DE 199 22 206 C2 2/2002
EP 0 639 437 A1 2/1995

* cited by examiner

*Primary Examiner* — Sunil Singh
(74) *Attorney, Agent, or Firm* — Baker & Hostetler LLP

(57) ABSTRACT

A cutting tool configuration for a ground milling machine, for example, a cold milling machine or a mining drill, is provided. The cutting tool configuration comprises a cutter holder, which is fastenable or fastened on a milling drum, a cutting tool, which is fastened on the cutter holder, and which is inserted using its cutting tool shaft in a cutter holder bore of the cutter holder and can rotate around its longitudinal axis, and a wear disc, which is situated rotation-locked between a stop surface of the cutter holder and the cutting tool head of the cutting tool, it being provided that the rotation lock between the wear disc and the cutter holder is caused by at least one groove formed on the outer circumference of the wear disc and a guide formed on the cutter holder and engaging in this groove. A wear disc for use in such a cutting tool configuration, and a cutting tool having such a preinstalled wear disc, are also provided.

8 Claims, 6 Drawing Sheets

CUTTING TOOL CONFIGURATION HAVING WEAR DISC

CROSS-REFERENCE TO RELATED APPLICATIONS

This application claims priority to foreign Patent Application DE 10 2010 026 106.8, filed on Jul. 5, 2010, the disclosure of which is incorporated herein by reference in its entirety.

FIELD OF THE INVENTION

The invention relates to a cutting tool configuration for a ground milling machine.

BACKGROUND OF THE INVENTION

Cutting tool configurations are used on ground milling machines, for example, road milling machines and trenchers, in particular cold milling machines, ground stabilizers/recyclers, and on mining drills, and are used to remove a ground material of an asphalt layer, inter alia. Typically, so-called round shaft cutters are used, which comprise a cutting tool head and a round cutting tool shaft, which is seated in a cutter holder bore of a cutter holder, whereby a rotation of the cutting tool around its longitudinal axis is made possible during cutting operation. A stop surface is provided on the cutter holder for the support of the cutting tool head. The cutter holder is in turn fastened on a milling drum, e.g., welded or screwed on. During cutting operation, the cutting tool is subjected to high wear and abrasion by the ground material to be cut. In particular, the stop surface on the cutter holder is also subjected to extraordinary wear by the rotating cutting tool and the ground material (e.g., rock powder), which has an abrasive effect.

SUMMARY OF THE INVENTION

One aspect of the invention improves a cutting tool configuration installation and maintenance friendliness.

This aspect is achieved by a cutting tool configuration in which rotation lock between the wear disc and the cutter holder is caused by at least one groove formed on the outer circumference of the wear disc and a guide that is formed on the cutter holder and which engages in this groove. Preferred and advantageous refinements and embodiments include a wear disc for use in a cutting tool configuration according to the invention and to a cutting tool having such a preinstalled wear disc.

A cutting tool configuration according to an embodiment of the invention comprises a cutter holder, which is fastenable or fastened on a milling drum, a cutting tool fastened on the cutter holder, the cutting tool shaft thereof (typically a round shaft) being able to be seated in a cutter holder bore of the cutter holder (standard holder or replacement holder) and being able to rotate around its longitudinal axis, and a wear disc, which is situated in a rotation-locked way between a stop surface of the cutter holder and the cutting tool head of the cutting tool. It is provided that the rotation lock between the wear disc and the cutter holder is caused by at least one groove or notch formed on the outer circumference or outer outline of the wear disc and a guide which is formed on the cutter holder and engages in this groove. The wear disc preferably has multiple grooves on the outer circumference, in each of which a corresponding guide on the cutter holder engages.

In relation to the external circumference of the wear disc, a groove has an inwardly pointing orientation (main direction). In particular, a groove has an essentially radial orientation in relation to the longitudinal axis of the cutting tool or in relation to the central bore of the wear disc (for the passage of the cutting tool shaft). The groove preferably has an at least approximately trapezoidal shape in the top view, the lateral groove flanks extending approximately radially.

The cutting tool configuration according to the invention has many advantages. One essential advantage is very good installation and maintenance friendliness, which is substantially to be attributed to the proposed system of the corresponding formfitting elements. A further advantage may be seen, for example, in the cost-effective producibility of the wear disc.

According to a preferred refinement, it is provided that the wear disc has at least one external auxiliary surface area in relation to a main surface, in which at least one groove is formed. The main surface is used for the stop of the wear disc on the stop surface of the cutter holder and the contact of the cutting tool head on the opposing side. The main surface has a central hole, which is provided for the passage of the cutting tool shaft, in order to be able to inserted into the cutter holder bore. The main surface is preferably formed approximately as a circular ring with respect to a top view.

According to a preferred refinement, it is provided that the at least one external auxiliary surface area of the wear disc is implemented as a partial or complete edge protector for the stop surface of the cutter holder.

According to a preferred refinement, it is provided that the external auxiliary surface area of the wear disc is formed as angled or beveled in relation to the main surface. The angling is performed along a curved line in particular. Furthermore, the auxiliary surface area particularly has a spatially curved surface.

According to a preferred refinement, it is provided that the main surface of the wear disc is formed having a surface bulge (crown). This surface bulge is used to enlarge the contact area between the wear disc and the stop surface of the cutter holder, on the one hand, which results in a lower surface pressure, and also for simplified centering of the wear disc on the stop surface, on the other hand.

According to a preferred refinement, it is provided that the wear disc has a collar which engages in the cutter holder bore of the cutter holder. This collar is preferably implemented as a peripheral collar around the central bore, which can engage in the cutter holder bore of the cutter holder, via which the wear disc can be centered in relation to the cutter holder. The cutter holder bore of the cutter holder is preferably provided with a corresponding centering chamfer.

According to a preferred refinement, it is provided that the wear disc is integrally formed from a spring steel material. In particular, the wear disc is produced as a sheet-metal molded part or stamped part, which is advantageous with respect to the strength and the production costs.

According to a preferred refinement, it is provided that at least one guide, which is formed on the cutter holder and engages in a groove of the wear disc, has a wear section which extends in particular in the longitudinal direction of the cutting tool. This is explained in greater detail hereafter in connection with the figures.

In the scope of the invention, protection is also claimed separately for a wear disc according to the preceding statements for use in a cutting tool configuration according to the invention.

Furthermore, protection is also claimed separately in the scope of the invention for a cutting tool having a preinstalled wear disc. Such an installation unit ensures that the wear disc is also automatically replaced during each cutter replacement. The at least temporary fixing of the wear disc on the cutting tool shaft can be caused in particular by an integral or multipart sleeve, by which the wear disc is mounted captively on the cutting tool shaft.

BRIEF DESCRIPTION OF THE DRAWINGS

The invention is described further for exemplary purposes hereafter on the basis of the figures. In the figures.

Figure 1:
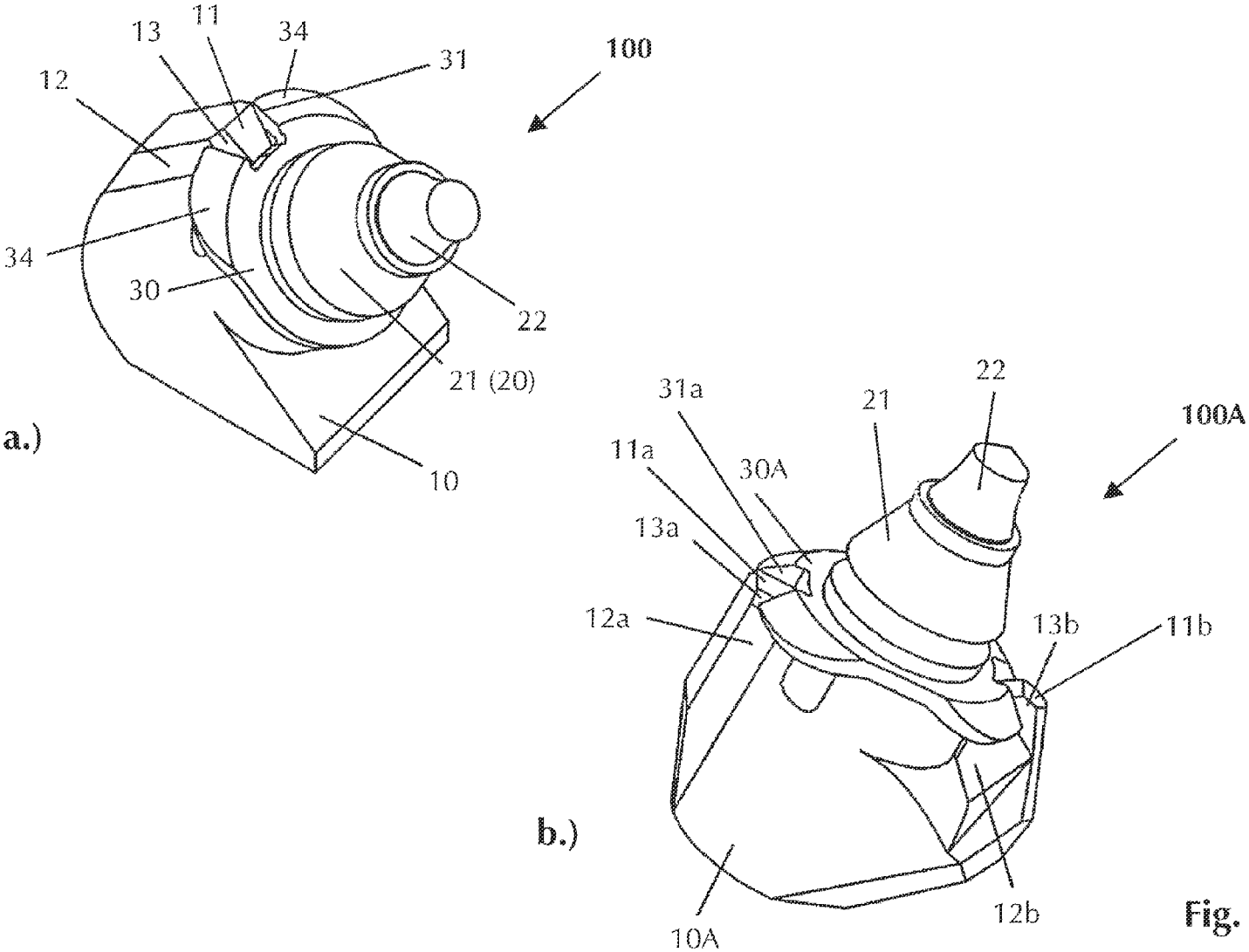
FIG. 1*a-b* show two exemplary embodiments of a cutting tool configuration according to the invention, each in a perspective view.

The features of the exemplary embodiments shown in the figures and explained hereafter can be combined with one another in the scope of the invention, if no technical contradiction results therefrom. Identical or functionally identical components are identified by the same reference numerals, different letters being appended individually to the reference numerals to differentiate the exemplary embodiments.

DETAILED DESCRIPTION

Embodiments of the invention advantageously provide a cutting tool configuration for a ground milling machine, for example, a cold milling machine, a ground stabilizer/recycler, or a mining drill, comprising a cutter holder, which is fastenable or fastened on a milling drum, a cutting tool, which is fastened on the cutter holder, and which is inserted using its cutting tool shaft in a cutter holder bore of the cutter holder and can rotate around its longitudinal axis, and a wear disc, which is situated in a rotation-locked way between a stop surface of the cutter holder and the cutting tool head of the cutting tool. Additional embodiments of the invention advantageously provide a wear disc for use in such a cutting tool configuration, as well as a cutting tool having a preinstalled wear disc.

FIG. 1*a* shows a cutting tool configuration identified as a whole by 100. The cutting tool configuration 100 comprises a cutter holder 10, which is fastened on a milling drum (or a rotor) (not shown). A cutting tool 20, of which only the cutting tool head 21 having the cutting tool tip 22 is visible, is fastened on the cutter holder 10. The cutting tool 20 is inserted using a round cutting tool shaft (see FIG. 6) in a cutter holder bore of the cutter holder 10 and can rotate around its longitudinal axis L (see FIG. 4). The cutting tool head 21 of the cutting tool 20 is supported in this case on a stop surface of the cutter holder 10 (see also FIG. 4).

A rotation-locked wear disc 30 is situated between the cutting tool head 21 and this stop surface. The rotation lock of the wear disc 30 is caused by a groove or notch 31 formed on the outer circumference of the wear disc 30 and a guide 11, which is formed on the cutter holder 10 and engages in a formfitting way in this groove 31. The guide 11 is implemented as a protrusion or bump (see FIG. 5, for example), and has two opposing guide flanks 12, which are provided in the upper area with chamfers 13 to simplify the installation. The cutter holder 10 is integrally formed.

FIG. 2*a* shows a perspective view of the top side of the wear disc 30 used in the exemplary embodiment of FIG. 1*a*. The wear disc 30 is integrally formed from a sheet-metal material. The wear disc 30 has a main surface 32 approximately in the form of a circular ring, which encloses a central bore 33 for the passage of the cutting tool shaft. The main surface 32 can be crowned upward or downward (not shown). An external auxiliary surface area 34 is situated on the main surface 32, in which the groove 31 is formed, the groove 31 extending in the radial direction up into the main surface 32 (see also FIG. 2*b*). The auxiliary surface area 34 is angled downward (in relation to a preferred installation position) along a curved or arced line 36 in relation to the main surface 32 (see also FIG. 4*a*). A peripheral chamfer on the upper edge of the central bore 33 is identified by 35.

FIG. 2*b* shows a top view of the wear disc 30. The preferred trapezoidal shape of the groove 31 may be seen very well in this illustration. The transitions 37 of the lateral groove flanks to the groove base 38 are formed having one radius. The groove base 38 is formed as an arc, the arc having a smaller radius in relation to the external outline of the main surface 32. The orientation (main direction) of the groove 31 in the radial direction to the center point of the bore 33 is indicated by 39.

FIG. 2*c* shows a perspective view of the bottom side of the wear disc 30. A peripheral collar 36, which points downward, around the bottom side of the central bore 33, may be seen very well in this illustration, the collar being able to engage in the cutter holder bore of the cutter holder 10, in particular the wear disc 30 being able to be centered in relation to the cutter holder 10 during the installation via the collar. The cutter holder bore in the cutter holder 10 is preferably formed having a centering chamfer corresponding to the collar 36.

The auxiliary surface area 34 on the wear disc 30 is also used as a partial edge protector for the peripheral edge of the stop surface on the cutter holder 10. This is shown very clearly in FIG. 1*a*.

Figure 3:
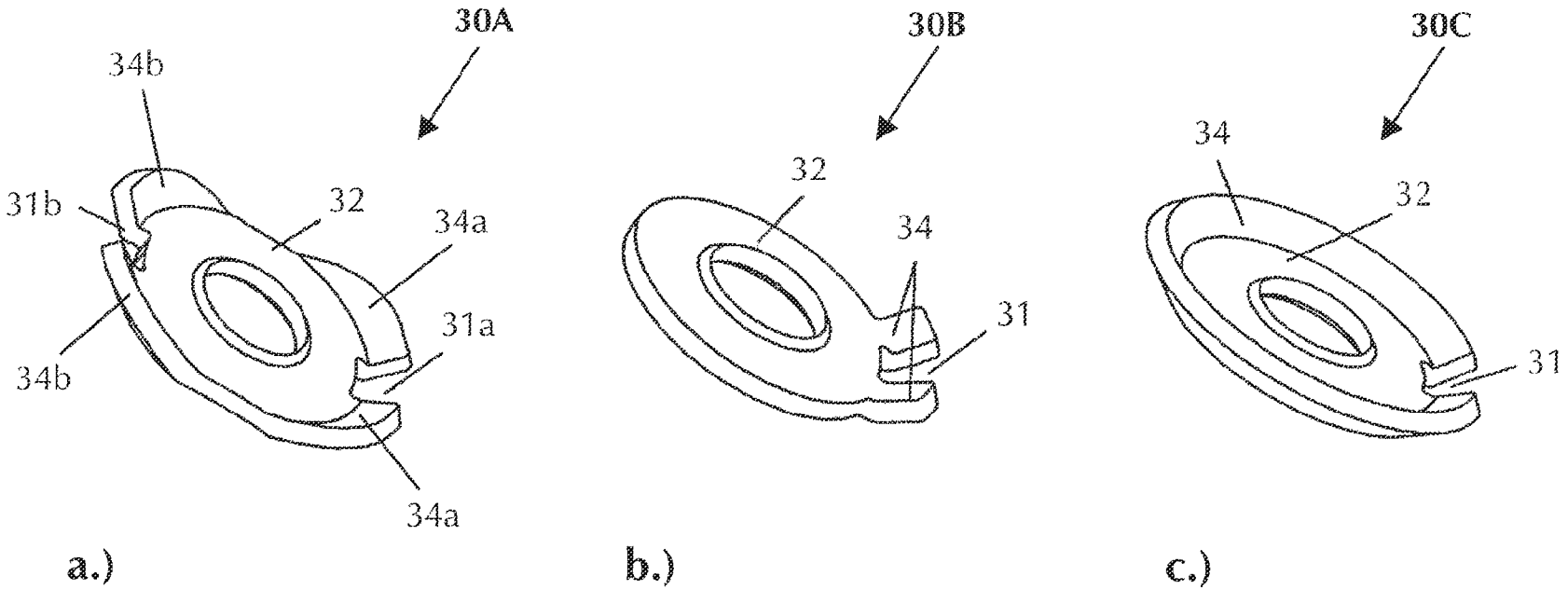
FIG. 3*a-c* show further exemplary embodiments of wear discs, each in a perspective view.

FIG. 3*c* shows a perspective view of the bottom side of an exemplary embodiment of a wear disc 30C, in which the auxiliary surface area 34 is formed as a collar-shaped surface section which completely encloses the main surface 32, and which is only interrupted by the groove 31. In this way, the wear disc 30 approximately has a plate shape. A complete edge protector for the peripheral edge on the stop surface of the cutter holder can be achieved by the collar-shaped auxiliary surface area 34.

Figure 2:
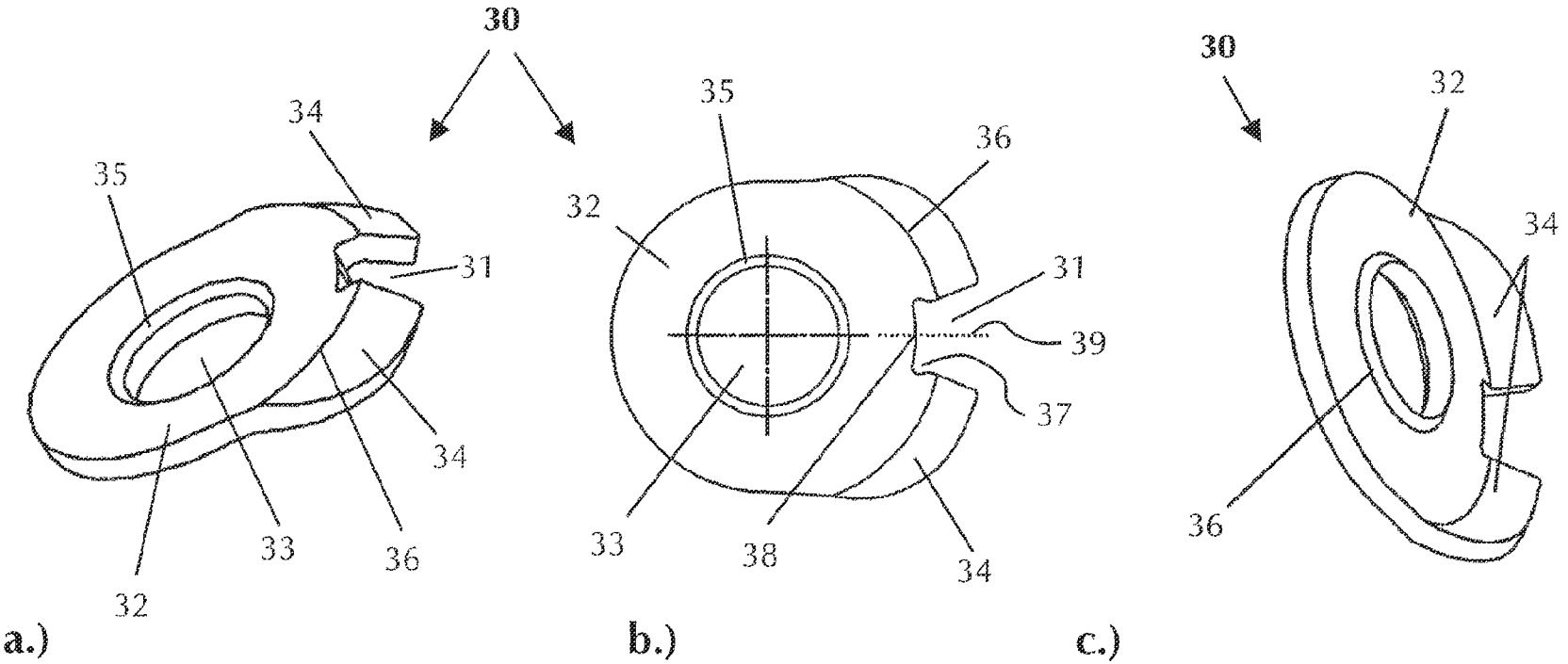
FIG. 2*a-c* show the wear disc used in the exemplary embodiment of FIG. 1*a*, in various views.

FIG. 3*a* shows, also in a perspective view of the bottom side, a further exemplary embodiment of a wear disc 30A, which is formed as essentially mirror-symmetric to the exemplary embodiment of FIG. 2 and which has two opposing auxiliary surface areas 34*a* and 34*b*, each having a groove 31*a* and 31*b* formed therein. FIG. 1*b* shows the cutting tool configuration 100A associated with this wear disc 30A. The cutter holder 10A has two guides 11*a* and 11*b* having guide flanks 12*a* and 12 situated thereon. The guide 11*b* is also provided with chamfers 13*b* in the upper area. The wear disc 30A may fundamentally also be used in the cutting tool configuration 100 of FIG. 1*a*.

Figure 4:
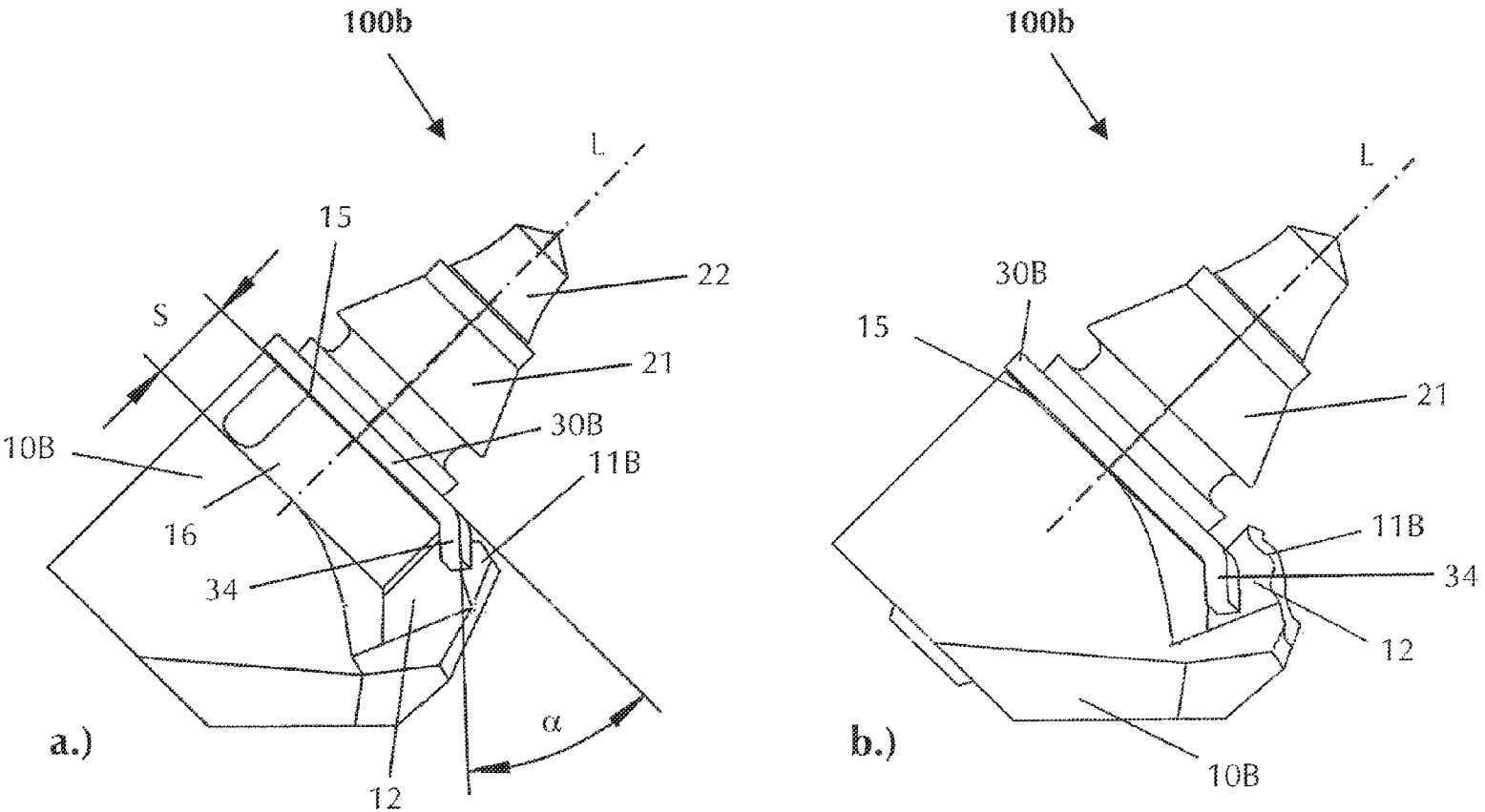
FIG. 4*a-b* show a cutting tool configuration according to the invention having an unworn cutter holder and a worn cutter holder, each in a side view.

FIG. 3*b* shows a further exemplary embodiment of a wear disc 30B, also in a perspective view of the bottom side, in which the auxiliary surface area 34 is formed to be comparatively small and compact. FIG. 4 shows the cutting tool configuration 100B associated with this wear disc 30B, the wear disc 30B fundamentally also being able to be used in the cutting tool configurations 100 and 100A of FIGS. 1*a* and 1*b*.

FIG. 4*a* shows a further exemplary embodiment, identified by 100B, of a cutting tool configuration according to the invention, in which a wear disc 30B according to FIG. 3*b* is used, for example. Notwithstanding the exemplary embodiment of FIG. 1*a*, the guide 11B on the cutter holder 10B is situated quasi-below the cutting tool head 21 with respect to the cutting tool 20, which has its longitudinal axis L inclined. A guide 11B could also be situated laterally on the cutter holder 10B in relation to the cutting tool head, which is true for all exemplary embodiments.

In the exemplary embodiments of a cutting tool configuration according to the invention shown in the figures, it is provided that the guide, which is formed on the cutter holder and engages in the groove of the wear disc, is formed having a defined wear section. This is explained in greater detail hereafter on the basis of FIG. 4.

As shown in the side view of FIG. 4*a*, the cutter holder 10B has an approximately cylindrically formed section 16, on the upper end of which the stop surface 15 is formed. This section 16, which is used as the wear section, also comprises the guide 11B. The permissible wear distance (target wear distance) is specified by S. Such a wear section 16 is also provided in the other exemplary embodiments. The wear section 16 allows, for example, typical wear discs which rotate with the cutting tool 20 to also be able to be used, for example, which then results in wear or abrasion (as explained at the beginning) of the wear section 16, however. Within the wear section 16, independently of the current wear state, the form fit between the groove of a rotation-locked wear disc (according to the preceding explanations) and the guide 11B can be ensured, if such a rotation-locked wear disc is to be used.

FIG. 4*b* shows the cutting tool configuration 100B having "worn-out" wear section 16, the cutting tool configuration 100B still being able to be operated using the rotation-locked wear disc 30B shown, for which the guide 11B is formed accordingly, in that the guide flanks 12 protrude down to below the stop surface 15 in relation to the longitudinal axis L. The guide 11B is also affected by the wear, as shown in FIG. 4*b*. The groove 31 of the wear disc 30B (this is also true for the other exemplary embodiments) is implemented so that a collision with the worn upper edge of the guide 11B is prevented. This is partially also caused by the angling of the auxiliary surface area 34. In FIG. 4*a*, this angling in relation to the main surface of the wear disc 30B or in relation to the plane of the stop surface 15 on the cutter holder 10B is illustrated (see angle $\alpha$). The angling or inclination also results in better engagement of the guide 11A in the groove, since the effective engagement length is expanded.

Figure 5:
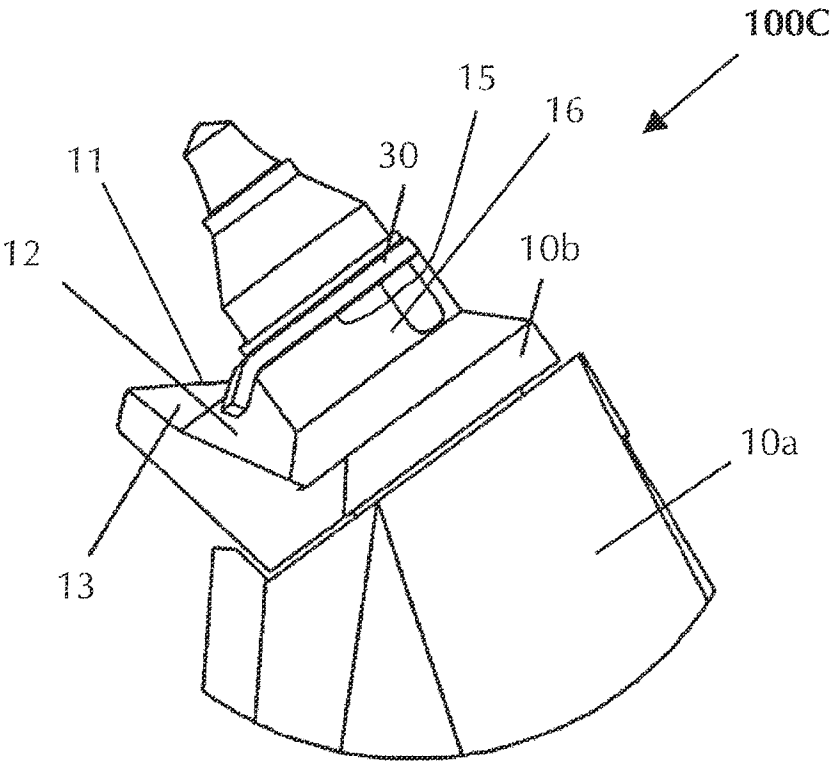
FIG. 5 shows a cutting tool configuration according to the invention having a replacement holder for the cutting tool, in a side view.

FIG. 5 shows a cutting tool configuration 100C according to the invention in which the cutter holder is implemented as a two-part cutter replacement holder 10*a*/10*b*. The stop surface 15, the guide 11, and the wear section 16 are situated on the replaceable upper part 10*b*. The upper part 10*b* is integrally formed.

Figure 6:
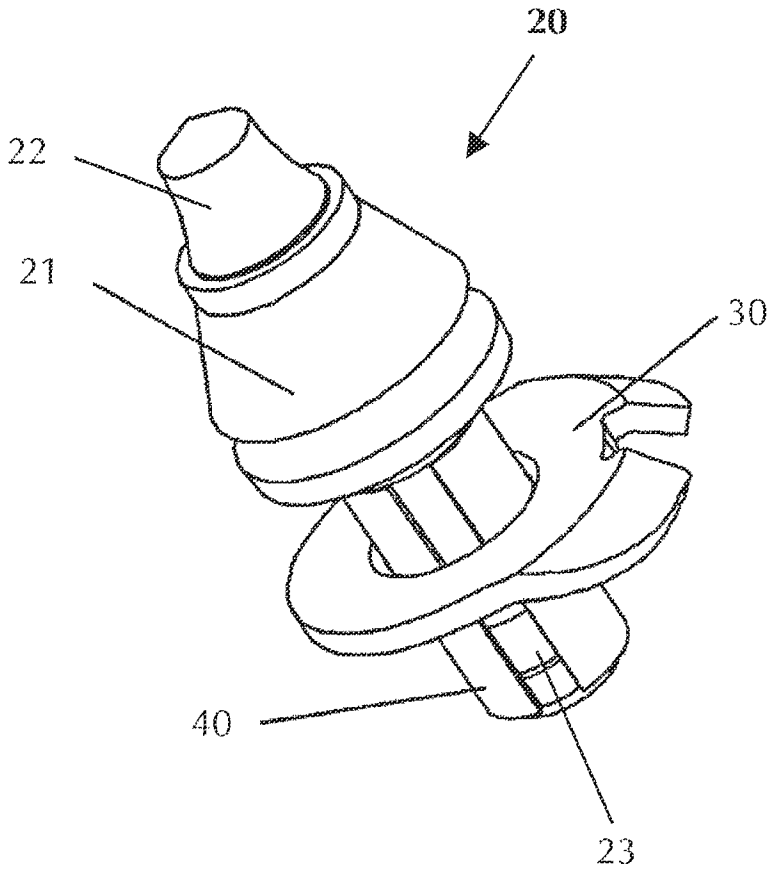
FIG. 6 shows a finished installation unit of a cutting tool having a wear disc fastened thereon, in a perspective view.

FIG. 6 shows a finished installation unit, which is particularly produced so it is ready for sales and/or distribution, a cutting tool 20 having a wear disc 30 fastened thereon, in a perspective view. The cutting tool head is identified by 21 and the cutting tool shaft, which is formed as a round shaft, is identified by 23. The cutting tool head 21 has a cutting tool tip 22, which is typically formed from a carbide. The wear disc 30 is preinstalled on the cutting tool shaft 23 and captively mounted using a sleeve 40. In this way, the loss of the wear disc 30 during the installation or replacement of the cutting tool 20 is also prevented.

What is claimed is:

1. A cutting tool system for a ground milling machine, comprising:

a cutter holder, including a cutting holder bore, a cutter holder stop surface and a cutter holder guide, fastenable on a milling drum;

a cutting tool, including a cutting tool head and a cutting tool shaft, rotatably seated in the cutter holder bore; and a wear disc, situated between said cutting tool head and said cutter holder stop surface, having a main surface in the form of a circular ring, and enclosing a central bore for the passage of said cutting tool shaft, wherein said cutter holder guide includes two guide flanks which extend below said stop surface in relation to the longitudinal axis; and wherein said wear disc includes at least one auxiliary surface, with the auxiliary surface being angled downward in relation to the main surface, and at least one groove formed on said auxiliary surface; and wherein said cutter holder guide engages said groove to prevent relative rotation between said wear disc and said cutter holder, providing;

a rotation-locked wear disc.

2. The cutting tool system according to claim 1, wherein the external auxiliary surface area is formed as an edge protector for the cutter holder stop surface.

3. The cutting tool system according to claim 1, wherein the main surface includes a surface bulge.

4. The cutting tool system according to claim 1, wherein the wear disc includes a collar that engages the cutter holder bore.

5. The cutting tool system according to claim 1, wherein the wear disc is integrally formed from a spring steel material.

6. The cutting tool system according to claim 1, wherein the cutter holder guide includes a wear section.

7. The cutting tool system according to claim 1, wherein the wear disc being at least temporarily mounted on the cutting tool shaft using a sleeve.

8. The cutting tool system according to claim 1, wherein the ground milling machine is a cold milling machine, a ground stabilizer/recycler, or a mining drill.

* * * * *